US006533621B1

(12) United States Patent
Yang et al.

(10) Patent No.: US 6,533,621 B1
(45) Date of Patent: Mar. 18, 2003

(54) SWIMMING DEVICE

(76) Inventors: Jiaqin Yang, 160A Dogwood Dr., SE, Milledgeville, GA (US) 31061; Jianmin Zhang, No. 502, Unit 4, Building 20, Xiang Jun Bei Li, Chaoyang District, Beijing (CN)

( * ) Notice: Subject to any disclaimer, the term of this patent is extended or adjusted under 35 U.S.C. 154(b) by 0 days.

(21) Appl. No.: 10/033,294

(22) Filed: Dec. 27, 2001

(51) Int. Cl.[7] ..... B63H 16/20
(52) U.S. Cl. ..... 440/31
(58) Field of Search ..... 440/31, 30, 29, 440/28, 27, 26, 21

(56) References Cited

U.S. PATENT DOCUMENTS

| | | | | | |
|---|---|---|---|---|---|
| 1,071,113 | A | | 8/1913 | Teters | 440/31 |
| 1,072,027 | A | * | 9/1913 | Mosteller | 440/29 |
| 1,277,022 | A | | 8/1918 | Young | 440/31 |
| 1,320,190 | A | * | 10/1919 | D'Aloisio | 440/31 |
| 1,321,267 | A | * | 11/1919 | Wilson | 440/31 |
| 1,578,584 | A | | 3/1926 | Cromer | 440/31 |
| 1,728,103 | A | * | 9/1929 | Chaligne | 440/31 |
| 1,752,051 | A | | 3/1930 | Young | 440/31 |
| 2,542,143 | A | * | 2/1951 | Jones | 440/31 |
| 3,111,109 | A | * | 11/1963 | Nicolaie | 440/31 |
| 3,133,522 | A | * | 5/1964 | Nicolaie | 440/28 |
| 3,570,436 | A | * | 3/1971 | Le Vasseur | 440/31 |
| 4,289,487 | A | | 9/1981 | Fattler | 440/31 |
| 5,643,020 | A | | 7/1997 | Harris | 440/31 |

* cited by examiner

*Primary Examiner*—S. Joseph Morano
*Assistant Examiner*—Lars A. Olson
(74) *Attorney, Agent, or Firm*—Merchant & Gould; Tim Tingkang Xia

(57) ABSTRACT

A swimming device operable by a user. In one embodiment of the present invention, the swimming device includes a frame having a body portion and an elongated portion, wherein the body portion has a first surface and an opposite second surface, and a first end and an opposite second end, the first surface receiving the upper body of the user, and the elongated portion has a first end associated with the second end of the body portion and an opposite second end defining an axis therebetween, and a channel extending from the first end of the elongated portion to the opposite second end of the elongated portion, and extending away from the second end of the body portion. The swimming device further includes a first housing and a second housing formed between the first surface and the second surface and positioned on each side of the axis of the elongated portion, respectively. Moreover, the swimming device includes a main shaft positioned between the first end and the second end of the elongated portion and rotatable about the axis of the elongated portion, the main shaft having a circumference of a size to be complementarily received in the channel of the elongated portion.

12 Claims, 5 Drawing Sheets

SWIMMING DEVICE

BACKGROUND OF THE INVENTION

1. Field of the Invention

This invention relates to a swimming device. More particularly, this invention relates to a swimming device that has a first propeller and a second propeller positioned substantially around the center of gravity of the swimming device so as to provide a stable underwater movement for the swimming device when the first propeller and the second propeller rotate.

2. The Prior Art

It is known that various recreational swimming devices using pedal-driven propellers have been proposed for allowing users to mechanically propel themselves in bodies of water as shown in, for examples, U.S. Pat. No. 1,071,113 to Teters, U.S. Pat. No. 1,578,584 to Cromer, U.S. Pat. No. 4,289,487 to Fattler, and U.S. Pat. Nos. 5,368,507 and 5,643,020 to Harris. Such devices are typically used for recreation, but can also provide a pleasurable method of exercising.

One of common characters of the currently available devices is that the propeller(s) of these devices is located at or close to the end of each device, mostly under a user's feet, which is distant from the center of gravity of the user (normally at the upper body of the user). Thus, the center of gravity of for each of the currently available devices and the center of gravity of the user are generally apart from other, which makes difficulty, some times dangerous, to operate these devices because they may produce unstable and unbalanced underwater movements. Additionally, it may cause inefficiencies in operation because a user may have to use energy to counter the unbalance.

Therefore, there is a need for a new type of swimming device that may provide a better, safer, stable and balanced underwater movement.

SUMMARY OF THE INVENTION

The above-noted disadvantages of the prior art are overcome by the present invention, which in one aspect is a swimming device operable by a user. In one embodiment of the present invention, the swimming device includes a frame having a body portion and an elongated portion, wherein the body portion has a first surface and an opposite second surface, and a first end and an opposite second end, the first surface receiving the upper body of the user, and the elongated portion has a first end associated with the second end of the body portion and an opposite second end defining an axis therebetween, and a channel extending from the first end of the elongated portion to the opposite second end of the elongated portion, and extending away from the second end of the body portion. The swimming device further includes a first housing and a second housing formed between the first surface and the second surface and positioned on each side of the axis of the elongated portion, respectively. Moreover, the swimming device includes a main shaft positioned between the first end and the second end of the elongated portion and rotatable about the axis of the elongated portion, the main shaft having a circumference of a size to be complementarily received in the channel of the elongated portion. Additionally, the swimming device includes a first pedal and a second pedal positioned on each side of the elongated portion near the second end of the elongated portion, respectively, the first pedal and the second pedal being rotatably coupled to the main shaft for receiving the feet of the user, so that the user may rotate the first pedal and the second pedal. The swimming device also includes a first propeller and a second propeller received in the first housing and the second housing, respectively, each of the first propeller and the second propeller being rotatably coupled to the main shaft, wherein the first propeller and the second propeller are positioned substantially around the center of gravity of the swimming device so as to provide a stable underwater movement when the first propeller and the second propeller rotate. Each of the first propeller and the second propeller has a thrust axis that is substantially parallel to the axis of the elongated portion. In operation, rotation of the first pedal and the second pedal causes rotation of the main shaft, which in turn causes the first propeller and the second propeller to generate thrust for propelling the swimming device in a desired direction.

The swimming device further includes a first drive shaft having a first end and an opposite second end, the first drive shaft being mounted between the first propeller and the second propeller and rotatably coupled to the main shaft and the first propeller near the first end and the second propeller near the second end, and a second drive shaft having a first end and an opposite second end, the second drive shaft being mounted between the first pedal and the second pedal and rotatably coupled to the main shaft and the first pedal near the first end and the second pedal near the second end.

The swimming device also includes transmission means for transmitting force from the pedals to the first propeller and the second propeller. In one embodiment, the transmission means has a first gear mounted to the second drive shaft, and a second gear mounted to the main shaft near the second end of the main shaft and positioned to be operatively connected to the first gear. The transmission means further has a third gear mounted to the main drive shaft near the first end of the main shaft, and a fourth gear mounted to the first drive shaft and positioned to be operatively connected to the third gear. The transmission means additionally has a fifth gear mounted to the first drive shaft near the first end of the first drive shaft, and a sixth gear rotatably connected to the first propeller and positioned to be operatively connected to the fifth gear. The transmission means further has a seventh gear mounted to the first drive shaft near the second end of the first drive shaft, and a eighth gear rotatably connected to the second propeller and positioned to be operatively connected to the seventh gear. Each of the first, second, third, fourth, fifth, sixth, seventh and eighth gears comprises a bevel gear. The gear ratio of the first and second gears, the gear ratio of the third and fourth gears, the gear ratio of the fifth and sixth gears, the gear ratio of the seventh and eighth gears can be selected individually or coordinately to accommodate the use of the swimming device.

In another embodiment of the present invention, the swimming device further comprises supporting means for supporting the main shaft and the first propeller and the second propeller. The supporting means has a first bearing positioned proximate to the first end of the main shaft and received in the channel of the elongated portion, and a second bearing positioned proximate to the second end of the main shaft and received in the channel of the elongated portion, wherein each of the first and second bearings has an opening in a complimentary size to receive the main shaft therein for supporting the main shaft. The supporting means further has a third bearing mounted in the first house and positioned proximate to one end of the thrust axis of the first propeller, and a fourth bearing mounted in the first house and positioned proximate to another end of the thrust axis of the first propeller, wherein each of the third and fourth bearings has an opening in a complimentary size to receive the first propeller therein for supporting the first propeller. The supporting means moreover has a fifth bearing mounted in the second house and positioned proximate to one end of the thrust axis of the second propeller, and a sixth bearing mounted in the second house and positioned proximate to another end of the thrust axis of the second propeller, wherein each of the fifth and sixth bearings has an opening in a complimentary size to receive the second propeller therein for supporting the second propeller.

Additionally, the swimming device further comprising adjustable attachment means positioned at the body portion of the frame for engaging the body portion of the frame with the user. The adjustable attachment means include adjustable belts, straps, dress or the like. Moreover, the first end of the elongated portion can be foldably associated with the body portion. In one embodiment, a folding screw is utilized for foldably associating the elongated portion with the body portion.

In another aspect, the present invention relates to a swimming device operable by a user. In one embodiment of the present invention, the swimming device includes a frame having a body portion and an elongated portion, wherein the body portion has a first surface and an opposite second surface, and a first end and an opposite second end, the first surface receiving the upper body of the user, and the elongated portion has a first end associated with the second end of the body portion and an opposite second end defining an axis therebetween, and a channel extending from the first end of the elongated portion to the opposite second end of the elongated portion, and extending away from the second end of the body portion. The swimming device further includes at least one housing formed between the first surface and the second surface. Moreover, the swimming device has a main shaft positioned between the first end and the second end of the elongated portion and rotatable about the axis of the elongated portion, the main shaft having a circumference of a size to be complementarily received in the channel of the elongated portion. Additionally, the swimming device has a first pedal and a second pedal positioned on each side of the elongated portion near the second end of the elongated portion, respectively, the first pedal and the second pedal being rotatably coupled to the main shaft for receiving the feet of the user, so that the user may rotate the first pedal and the second pedal. The swimming device further has at least one propeller received in the at least one housing and being rotatably coupled to the main shaft, wherein the at least one propeller is positioned substantially around the center of gravity of the swimming device so as to provide a stable underwater movement when the at least one propeller rotates. In operation, rotation of the first pedal and the second pedal causes rotation of the main shaft, which in turn causes the at least one propeller to generate thrust for propelling the swimming device in a desired direction.

In one embodiment, the swimming device further includes transmission means for transmitting force from the pedals to the at least one propeller, and supporting means for supporting the main shaft and the at least one propeller. The swimming device may have an additional propeller positioned around the center of gravity of the swimming device coordinating with the at least one propeller to generate thrust for propelling the swimming device.

In a further aspect, the present invention relates to a swimming device operable by a user. In one embodiment of the present invention, the swimming device includes a frame having a body portion and an elongated portion, wherein the body portion has a first surface and an opposite second surface, and a first end and an opposite second end, the first surface receiving the upper body of the user, and the elongated portion has a first end associated with the second end of the body portion and an opposite second end defining an axis therebetween, and a channel extending from the first end of the elongated portion to the opposite second end of the elongated portion, and extending away from the second end of the body portion. Additionally, the swimming device has a first housing and a second housing formed between the first surface and the second surface and positioned on each side of the axis of the elongated portion, respectively. The swimming device further has a main shaft positioned between the first end and the second end of the elongated portion and rotatable about the axis of the elongated portion, the main shaft having a circumference of a size to be complementarily received in the channel of the elongated portion. Moreover, the swimming device has a first pedal and a second pedal positioned on each side of the elongated portion near the second end of the elongated portion, respectively, the first pedal and the second pedal being rotatably coupled to the main shaft for receiving the feet of the user, so that the user may rotate the first pedal and the second pedal.

In one embodiment, a first propeller and a second propeller are received in the first housing and the second housing, respectively, where each of the first propeller and the second propeller is rotatably coupled to the main shaft. The swimming device has a first drive shaft having a first end and an opposite second end, the first drive shaft being mounted between the first propeller and the second propeller and rotatably coupled to the main shaft and the first propeller near the first end and the second propeller near the second end. The swimming device further has a second drive shaft having a first end and an opposite second end, the second drive shaft being mounted between the first pedal and the second pedal and rotatably coupled to the main shaft and the first pedal near the first end and the second pedal near the second end. Moreover, a first pair of gears are operatively connected to each other for transmitting power from the second drive shaft to the main shaft, a second pair of gears are operatively connected to each other for transmitting power from the main shaft to the first drive shaft, a third pair of gears are operatively connected to each other for transmitting power from the first drive shaft to the first propeller, and a fourth pair of gears are operatively connected to each other for transmitting power from the first drive shaft to the second propeller, whereby rotation of the first pedal and the second pedal causes rotation of the main shaft through the first pair of gears, which in turn causes the first propeller and the second propeller through the second, the third and the fourth pairs of gears, respectively, to generate thrust for propelling the swimming device in a desired direction.

These and other aspects will become apparent from the following description of the preferred embodiment taken in conjunction with the following drawings, although variations and modifications may be effected without departing from the spirit and scope of the novel concepts of the disclosure.

DETAILED DESCRIPTION OF THE INVENTION

Figure 1:
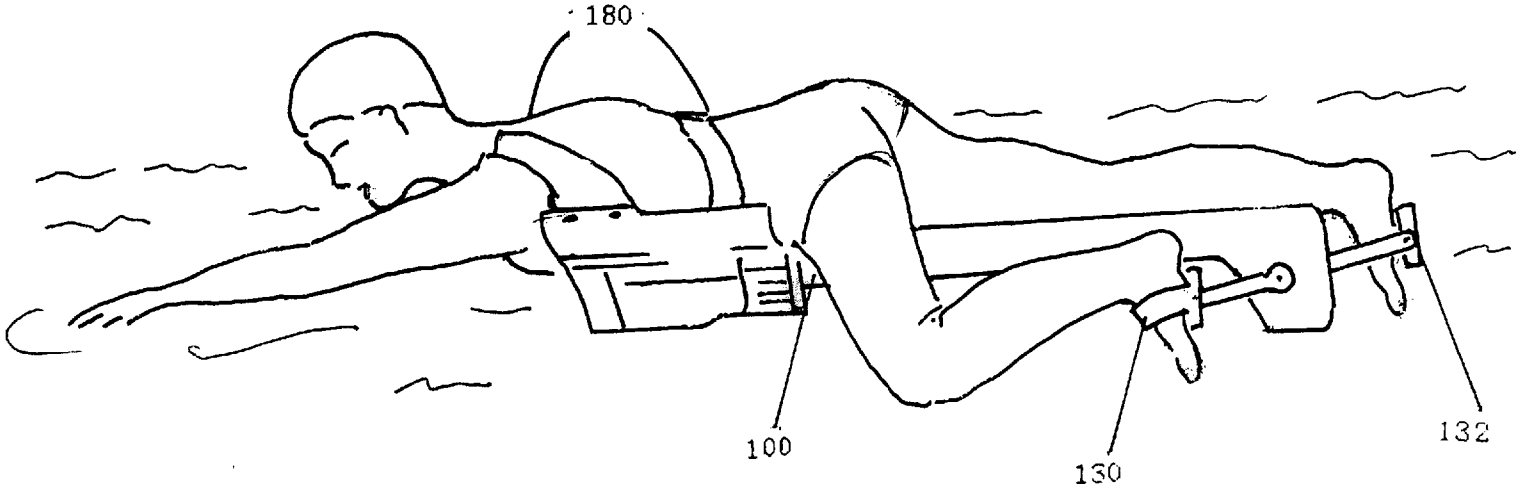
FIG. 1 is a perspective view of a swimming device in one embodiment in accordance with the present invention, the view illustrating the appliance in use and the user in a swimming posture.

Various embodiments of the invention are now described in detail. Referring to the drawings, like numbers indicate like parts throughout the views. As used in the description herein and throughout the claims that follow, the meaning of"a," "an," and "the" includes plural reference unless the context clearly dictates otherwise. Also, as used in the description herein and throughout the claims that follow, the meaning of "in" includes "in" and "on" unless the context clearly dictates otherwise.

Referring now to FIGS. 1–5, several embodiments of the swimming device of the invention are shown. In one embodiment of the present invention, referring first to FIGS. 2, 3 and 3A, a swimming device 200 includes a frame 202 that has a body portion 204 and an elongated portion 206. The body portion 204 has a first surface 210 and an opposite second surface 212, and a first end 214 and an opposite second end 216. The body portion 204 is defined between the first end 214 and the second end 216. The first surface 210 is adapted to receive at least partially the upper body of a user. The elongated portion 206 has a first end 220 associated with the second end 216 of the body portion 204 and an opposite second end 222 defining an axis A therebetween. The axis A divides the swimming device 200 into a first side portion 201 and a second side portion 203. In one embodiment, the first side portion 201 and the second side portion 203 are formed to be substantially symmetrical about the axis A. The elongated portion 206 is a hollow structure and has a channel 224 extending from the first end 220 of the elongated portion 206 to substantially near the opposite second end 222 of the elongated portion 206, and extending away from the second end 216 of the body portion 204. Moreover, the swimming device 200 includes a main shaft 226 positioned between the first end 220 and the second end 222 of the elongated portion 206 and rotatable about the axis A. As partially shown in FIG. 3A, the main shaft 226 has a circumference of a size to be complementarily received in the channel 224 of the elongated portion 206. Additionally, the swimming device 200 includes a first pedal 230 and a second pedal 232 positioned on each side of the elongated portion 206 near the second end 222 of the elongated portion 206, respectively. The first pedal 230 and the second pedal 232 each is rotatably coupled to the main shaft 226 for receiving the feet of the user, so that the user may rotate the first pedal 230 and the second pedal 232.

The swimming device 200 further includes a first housing 240 and a second housing 242 formed between the first surface 210 and the second surface 212 and positioned on each side of the axis A of the elongated portion, respectively. A first propeller 244 and a second propeller 246 are received in the first housing 240 and the second housing 242, respectively. Each of the first propeller 244 and the second propeller 246 is rotatably coupled to the main shaft 226, wherein the first propeller 244 and the second propeller 246 are positioned substantially around the center of gravity of the swimming device 200 so as to provide a stable underwater movement when the first propeller 244 and the second propeller 246 rotate. The center of gravity of the swimming device 200 is practically located at the center of mass of the swimming device 200, which exact location depends on the spatial distribution of various parts making up the swimming device 200. In the embodiment as shown in FIGS. 1–5, the center of gravity of the swimming device 200 is approximately located along the axis A, at a position in the body portion 204, closer to the second end 216 than to the first end 214. Each of the first propeller 244 and the second propeller 246 has a thrust axis (245 or 247) that is substantially parallel to the axis A of the elongated portion 206. Each of the first propeller 244 and the second propeller 246 is a dual-directional propeller. In operation, rotation of the first pedal 230 and the second pedal 232 causes rotation of the main shaft 226 about the axis A, which in turn causes the first propeller 244 and the second propeller 246 to rotate about the thrust axises, respectively, to generate thrust for propelling the swimming device 200 in a desired direction as discussed in more detail below.

Figure 4:
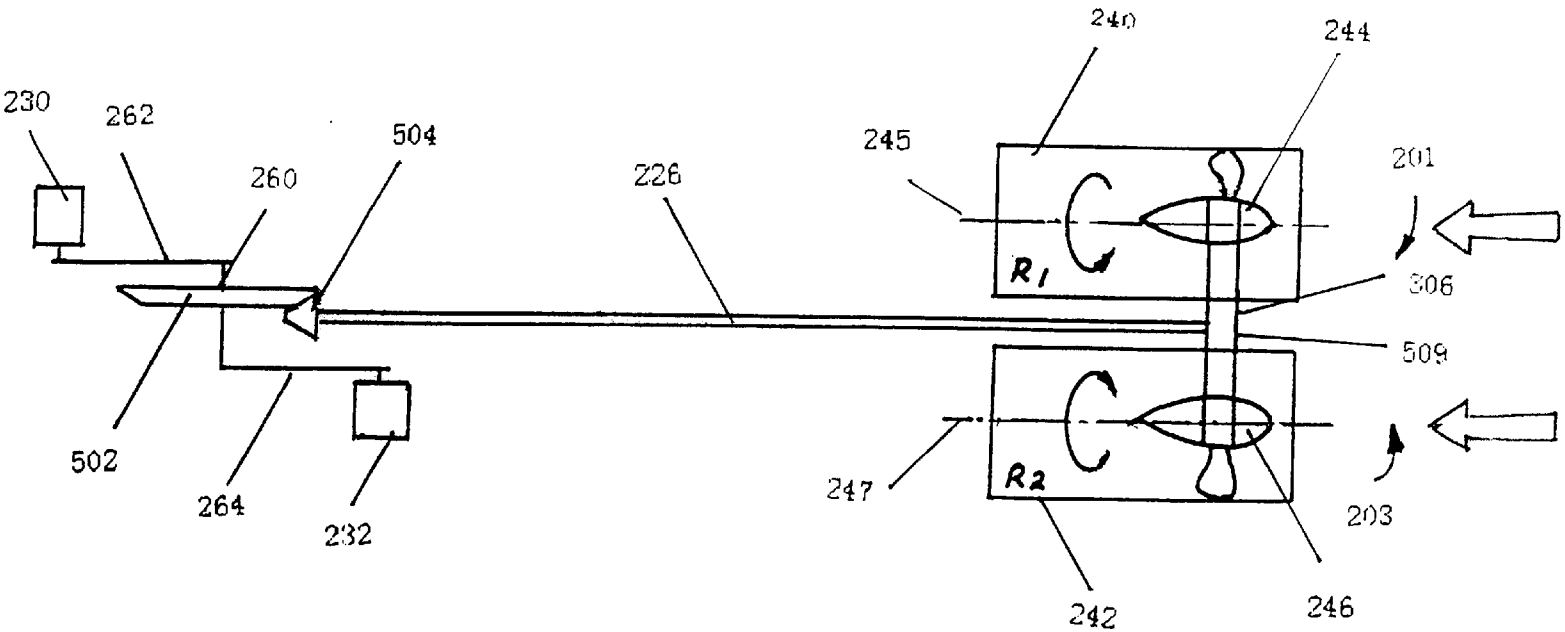
FIG. 4 is a schematic showing several parts of a swimming device in one embodiment in accordance with the present invention.
Figure 5:
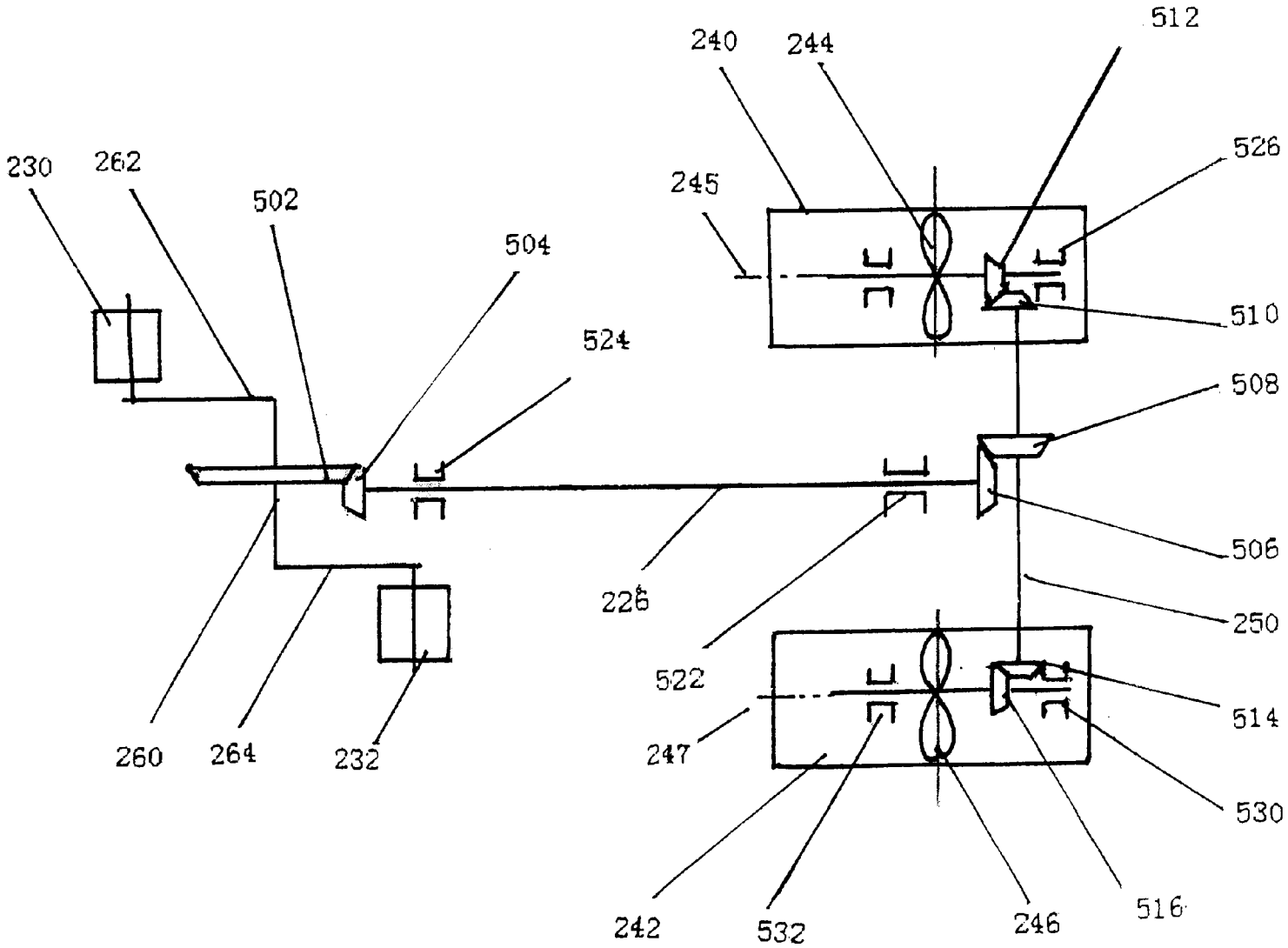
FIG. 5 is a schematic showing the transmission configuration of a swimming device in one embodiment in accordance with the present invention.

Referring now to FIGS. 4 and 5, the swimming device 200 may further include a first drive shaft 250 having a first end 252 and an opposite second end 254. The first drive shaft 250 is mounted between the first propeller 244 and the second propeller 246 and rotatably coupled to the main shaft 226 and the first propeller 244 near the first end 252 and the second propeller 246 near the second end 254. The swimming device 200 also may have a second drive shaft 260 having a first end 262 and an opposite second end 264. The second drive shaft 260 is mounted between the first pedal 230 and the second pedal 232 and rotatably coupled to the main shaft 226 and the first pedal 230 near the first end 262 and the second pedal 232 near the second end 264.

The swimming device of the present invention also includes transmission means for transmitting force from the pedal(s) to the propeller(s). In one embodiment as shown in FIG. 5, the transmission means 500 has a first gear 502 mounted to the second drive shaft 260, and a second gear 504 mounted to the main shaft 226 near the second end 228 of the main shaft 226 and positioned to be operatively connected to the first gear 502. The transmission means 500 further has a third gear 506 mounted to the main drive shaft 226 near the first end 227 of the main shaft 226, and a fourth gear 508 mounted to the first drive shaft 250 and positioned to be operatively connected to the third gear 506. The fourth gear can alternatively be positioned as gear 509 shown in FIG. 4. The transmission means 500 additionally has a fifth gear 510 mounted to the first drive shaft 250 near the first end 252 of the first drive shaft 250, and a sixth gear 512 rotatably connected to the first propeller 244 and positioned to be operatively connected to the fifth gear 510. The transmission means 500 further has a seventh gear 514 mounted to the first drive shaft 250 near the second end 254 of the first drive shaft 252, and a eighth gear 516 rotatably connected to the second propeller 246 and positioned to be operatively connected to the seventh gear 516.

In this embodiment, each of the first, second, third, fourth, fifth, sixth, seventh and eighth gears 502, 504, 506, 508, 510, 512, 514 and 516 may comprise a bevel gear. The first and second gears 502, 504 form a first pair of gears operatively connected to each other for transmitting power from the second drive shaft 260 to the main shaft 226. The third and fourth gears 506, 508 form a second pair of gears operatively connected to each other for transmitting power from the main shaft 226 to the first drive shaft 250. The fifth and six gears 510, 512 form a third pair of gears operatively connected to each other for transmitting power from the third drive shaft 250 to the first propeller 244. Likewise, the seventh and eighth gears 514, 516 form a fourth pair of gears operatively connected to each other for transmitting power from the third drive shaft 250 to the second propeller 246. The gear ratio of the first and second gears, the gear ratio of the third and fourth gears, the gear ratio of the fifth and sixth gears, the gear ratio of the seventh and eighth gears can be selected individually or coordinately to accommodate the use of the swimming device. In general, each gear ratio can be chosen in a range of 1:5 to 1:2 (or 5:1 to 2:1 depending on the relative positions of the gears as known to people skilled in the art). Moreover, the third, fourth, fifth, sixth, seventh and eighth gears 506, 508, 510, 512, 514 and 516 are chosen and arranged are arranged so that the first and second propellers 244, 246 are rotated in opposite directions in operation to generate a balanced thrust for propelling the swimming device 200 in a desired direction.

Because each of the first propeller 244 and the second propeller 246 is a dual-directional propeller, there are totally four operational modes in term of rotational arrangement: a. both rotating clockwise; b. both rotating counter clockwise; c. first propeller 244 rotating clockwise and second propeller 246 rotating counter clockwise; and d. first propeller 244 rotating counter clockwise and second propeller 246 rotating clockwise. Each rotational arrangement can be selected to practice the present invention. In a particular embodiment as shown in FIG. 4, the third, fourth, fifth, sixth, seventh and eighth gears 506, 508, 510, 512, 514 and 516 are chosen and arranged are arranged so that the first propeller 244 rotates in a direction $R_1$ towards the axis A from the side 201 (count clockwise as shown), and the second propeller 246 rotates in a direction $R_2$ towards the axis A from the side 203 (clockwise as shown), where $R_1$ and $R_2$ are opposite directions. In this embodiment, with the choice of the rotation directions of the propellers and the locations of the propellers (towards to the center of gravity of the swimming device 200), the first and second propellers 244, 246 not only generate a balanced thrust for propelling the swimming device 200 in a desired direction F as shown but stabilize the underwater movement of the swimming device 200.

In another embodiment of the present invention, the swimming device further comprises supporting means for supporting the main shaft and the propeller(s). In one embodiment as schematically shown in FIG. 5, the supporting means has a first bearing 522 positioned proximate to the first end 227 of the main shaft 226 and received in the channel 224 of the elongated portion 206, and a second bearing 524 positioned proximate to the second end 228 of the main shaft 226 and received in the channel 224 of the elongated portion 206. Each of the first and second bearings 522, 524 has an opening in a complimentary size to receive the main shaft 226 therein for supporting the main shaft 226. The supporting means may further have a third bearing 526 mounted in the first house 240 and positioned proximate to one end of the thrust axis of the first propeller 244, and a fourth bearing 528 mounted in the first house 240 and positioned proximate to another end of the thrust axis of the first propeller 244, wherein each of the third and fourth bearings 526, 528 has an opening in a complimentary size to receive the first propeller 244 therein for supporting the first propeller 244. The supporting means may additionally have a fifth bearing 530 mounted in the second house 242 and positioned proximate to one end of the thrust axis of the second propeller 246, and a sixth bearing 532 mounted in the second house 242 and positioned proximate to another end of the thrust axis of the second propeller 246, wherein each of the fifth and sixth bearings 530, 532 has an opening in a complimentary size to receive the second propeller 246 therein for supporting the second propeller 246.

Figure 2:
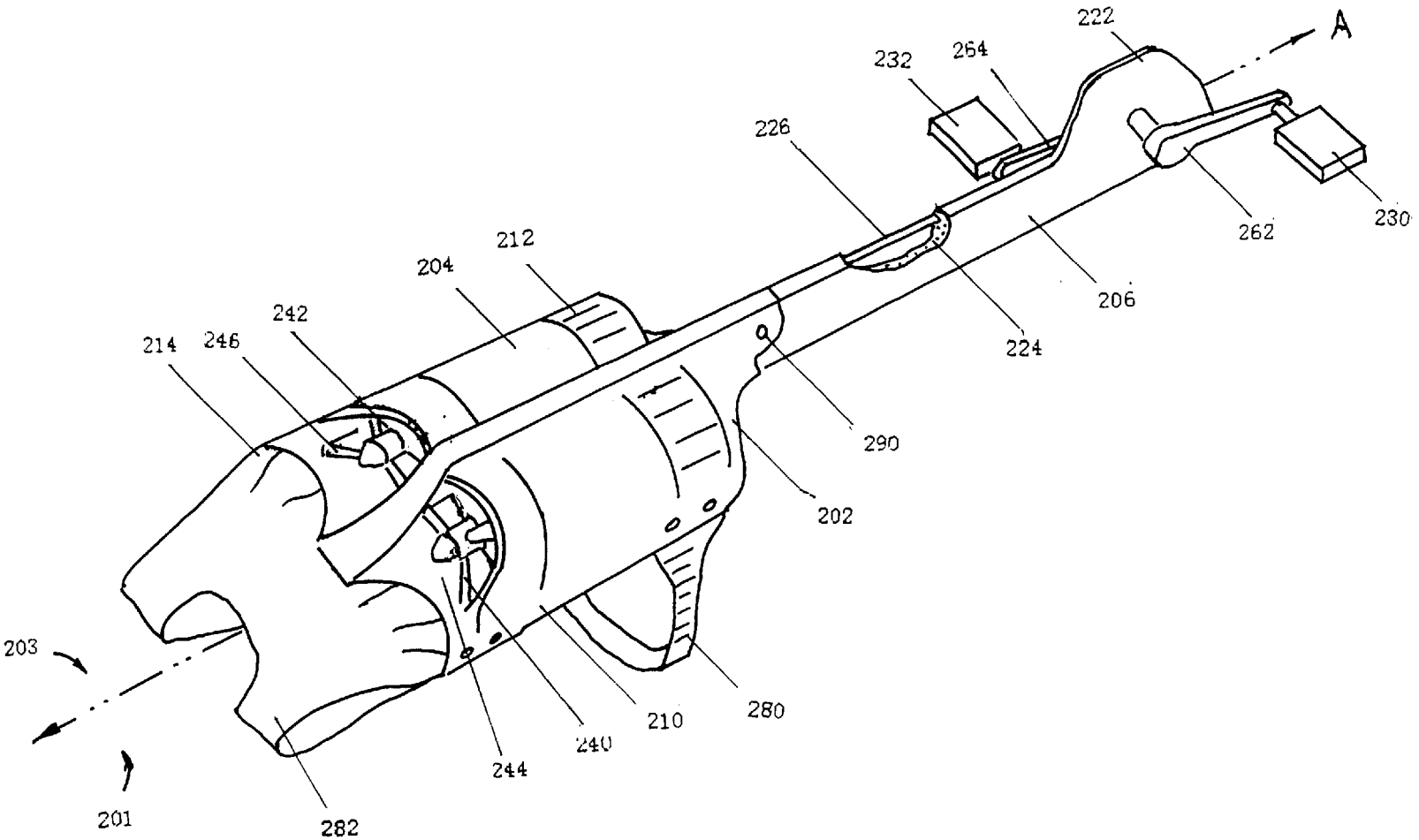
FIG. 2 is another perspective view of a swimming device in one embodiment in accordance with the present invention.
Figures 3, 3A:
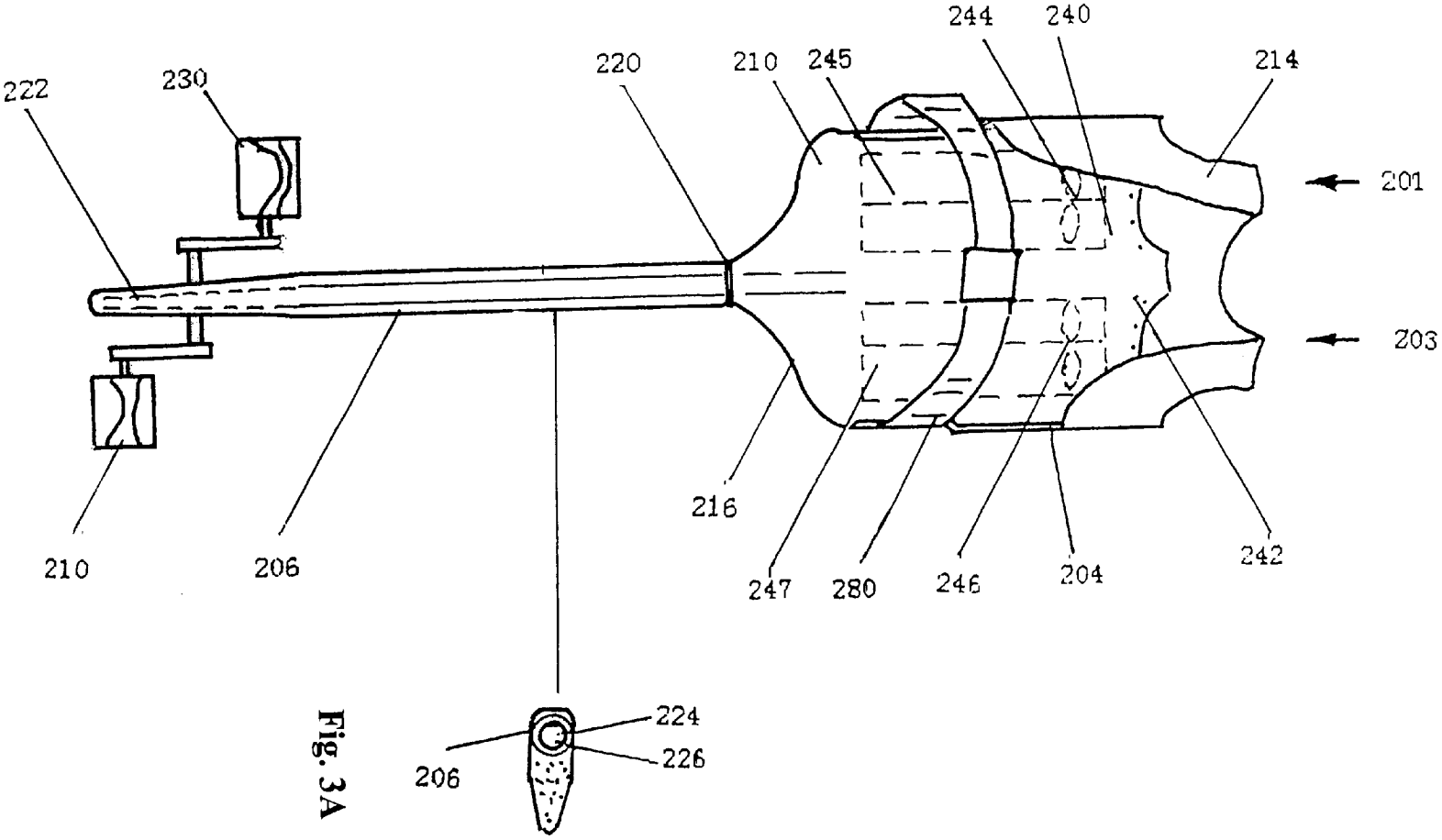
FIG. 3 is a top plan view of a swimming device in one embodiment in accordance with the present invention.
FIG. 3A is a cross-sectional view showing parts of a swimming device in one embodiment in accordance with the present invention, taken along line 3A—3A of FIG 3.

Additionally, referring now back to FIGS. 2 and 3, the swimming device 200 may further have adjustable attachment means 280 positioned at the body portion 204 of the frame 202 for engaging the frame 202 with the user. The adjustable attachment means 280 may include adjustable belts 280 as shown in FIG. 2, straps, dress 282 as shown in FIG. 2 or the like or any combination of them.

Moreover, the first end 220 of the elongated portion 206 can be foldably associated with the body portion 204. In one embodiment as shown in FIG. 2, a folding screw 290 is utilized for foldably associating the elongated portion 206 with the body portion 204 through complemenarily sized threaded holes located in the elongated portion 206 and the body portion 204 (not shown), respectively. This foldablity provides more portability to the swimming device of the present invention.

The swimming device of the present invention can be made from a variety of materials such as plastics, metals, nylon, wood, or a combination of them. Preferably, while it is not necessary, the swimming device of the present invention should be mainly made form light, floatable materials such as plastics. Different parts of the swimming device of the present invention can be made from different material. For example, the body portion of the swimming device of the present invention can be made from a plastic that is comfortable to human body yet has enough strength to house the propeller(s) while the gears may be made from metals or same or different kinds of plastics. Parts of the swimming device can be made with curvature and smooth geometric forms to minimize water resistance.

As shown in FIG. 1, in use, a user attaches a swimming device 100 of the present invention to her or his upper body through attachment means 180. In a forward position as shown, the user pedals the swimming device 100 underwater by using her or his feet through pedals 136, 132 like biking a bicycle. Additionally, the user can use her or his hands freely to further facilitate the motion. As the user forces the pedals 130, 132 to rotate, the rotation of the pedals 130, 132 causes rotation of a main shaft (not shown), which in turn causes a first propeller and a second propeller (not shown) to rotate in opposite directions as discussed above to generate thrust for propelling the swimming device 100 and therefore the user in a desired direction. In such a forward position in the water, the center of gravity of the user in general is located somewhere in her or his upper body, which is located near to, or even approximately overlaps with, the center of gravity of the swimming device 100. Therefore, the swimming device 100 and the user equivalently forms a coherent body of motion to provide an efficient and stable underwater movement that no prior art device can offer.

From the description above, among other things, a number of advantages of a swimming device according to the present invention become evident:

(a) The propeller(s) of the swimming device of the present invention are positioned substantially around or near the center of gravity of the device so as to provide a user stable and balanced underwater movement when the swimming device is operated;

(b) The transmission mechanism of the swimming device allows a user to adjust the device in terms of speed setting, speed control, and other motion parameters;

(c) The configuration of the swimming device of the present invention (an extended body portion and an elongated transmission portion) allows minimum separation between the swimming device and the user so that the device and the user to form an integral body of motion for efficient and effective underwater movement; and (d) The safety of the user is increased due to the balanced motion created by the user and the swimming device because the centers of gravity of them are close to each other in operational mode.

The above described embodiments are given as an illustrative examples only. It will be readily appreciated that many deviations may be made from the specific embodiment disclosed in this specification without departing from the invention. For example, each or at least one pair of gears may be replaced by a group of gears so as to allow a user move freedom to adjust or change swimming speed or motion strength. Additionally, a single propeller or three or more propellers practice configuration can also be utilized to the invention. Accordingly, the scope of the invention is to be determined by the claims below rather than being limited to the specifically described embodiment above.

What is claimed is:

1. A swimming device operable by a user, comprising:

a. a frame having a body potion and an elongated portion, wherein the body portion has a first surface and an opposite second surface, and a first end and an opposite second end, the first surface receiving the upper body of the user, and the elongated portion has a first end associated with the second end of the body portion and an opposite second end defining an axis therebetween, and a channel extending from the first end of the elongated portion to the opposite second end of the elongated portion, and extending away from the second end of the body portion;

b. a first housing and a second housing formed between the first surface and the second surface and positioned on each side of the axis of the elongated portion, respectively;

c. a main shaft positioned between the first end and the second end of the elongated portion and rotatable about the axis of the elongated portion, the main shaft having a circumference of a size to be complementarily received in the channel of the elongated portion;

d. a first pedal and a second pedal positioned on each side of the elongated portion near the second end of the elongated portion, respectively, the first pedal and the second pedal being rotatably coupled to the main shaft for receiving the feet of the user, so that the user may rotate the first pedal and the second pedal;

e. a first propeller and a second propeller received in the first housing and the second housing, respectively, each of the first propeller and the second propeller being rotatably coupled to the main shaft, f. a first drive shaft having a first end and an opposite second end, the first drive shaft being mounted between the first propeller and the second propeller and rotatably coupled to the main shaft and the first propeller near the first end and the second propeller near the second end; and g. a second drive shaft having a first end and an opposite second end, the second drive shaft being mounted between the first pedal and the second pedal and rotatably coupled to the main shaft and the first pedal near the first end and the second pedal near the second end, wherein the first propeller and the second propeller are positioned substantially around the center of gravity of the swimming device so as to provide a stable underwater movement when the first propeller and the second propeller rotate, whereby rotation of the first pedal and the second pedal causes rotation of the main shaft, which in turn causes the first propeller and the second propeller to generate thrust for propelling the swimming device in a desired direction.

2. The swimming device of claim 1, further comprising transmission means for transmitting force from the pedals to the first propeller and the second propeller.

3. The swimming device of claim 2, wherein the transmission means comprises:

a. a first gear mounted to the second drive shaft; and b. a second gear mounted to the main shaft near the second end of the main shaft and positioned to be operatively connected to the first gear.

4. The swimming device of claim 3, wherein the transmission means further comprises:

a. a third gear mounted to the main drive shaft near the first end of the main shaft; and b. a fourth gear mounted to the first drive shaft and positioned to be operatively connected to the third gear.

5. The swimming device of claim 4, wherein the transmission means further comprises:

a. a fifth gear mounted to the first drive shaft near the first end of the first drive shaft; and b. a sixth gear rotatably connected to the first propeller and positioned to be operatively connected to the fifth gear.

6. The swimming device of claim 5, wherein the transmission means further comprises:

a. a seventh gear mounted to the first drive shaft near the second end of the first drive shaft; and b. a eighth gear rotatably connected to the second propeller and positioned to be operatively connected to the seventh gear.

7. The swimming device of claim 6, wherein each of the first, second, third, fourth, fifth, sixth, seventh and eighth gears comprises a bevel gear.

8. The swimming device of claim 1, further comprising supporting means for supporting the main shaft and the first propeller and the second propeller.

9. The swimming device of claim 8, wherein the supporting means comprises:

a. a first bearing positioned proximate to the first end of the main shaft and received in the channel of the elongated portion; and b. a second bearing positioned proximate to the second end of the main shaft and received in the channel of the elongated portion, wherein each of the first and second bearings has an opening in a complimentary size to receive the main shaft therein for supporting the main shaft.

10. The swimming device of claim 9, wherein the supporting means further comprises:

a. a third bearing mounted in the first house and positioned proximate to one end of the thrust axis of the first propeller; and b. a fourth bearing mounted in the first house and positioned proximate to another end of the thrust axis of the first propeller, wherein each of the third and fourth bearings has an opening in a complimentary size to receive the first propeller therein for supporting the first propeller.

11. The swimming device of claim 10, wherein the supporting means further comprises:

a. a fifth bearing mounted in the second house and positioned proximate to one end of the thrust axis of the second propeller; and b. a sixth bearing mounted in the second house and positioned proximate to another end of the thrust axis of the second propeller, wherein each of the fifth and sixth bearings has an opening in a complimentary size to receive the second propeller therein for supporting the second propeller.

12. A swimming device operable by a user, comprising:

a. a frame having a body portion and an elongated portion, wherein the body portion has a first surface and an opposite second surface, and a first end and an opposite second end, the first surface receiving the upper body of the user, and the elongated portion has a first end associated with the second end of the body portion and an opposite second end defining an axis therebetween, and a channel extending from the first end of the elongated portion to the opposite second end of the elongated portion, and extending away from the second end of the body portion;

b. a first housing and a second housing formed between the first surface and the second surface and positioned on each side of the axis of the elongated portion, respectively;

c. a main shaft positioned between the first end and the second end of the elongated portion and rotatable about the axis of the elongated portion, the main shaft having a circumference of a size to be complementarily received in the channel of the elongated portion;

d. a first pedal and a second pedal positioned on each side of the elongated portion near the second end of the elongated portion, respectively, the first pedal and the second pedal being rotatably coupled to the main shaft for receiving the feet of the user, so that the user may rotate the first pedal and the second pedal;

e. a first propeller and a second propeller received in the first housing and the second housing, respectively, each of the first propeller and the second propeller being rotatably coupled to the main shaft;

f. a first drive shaft having a first end and an opposite second end, the first drive shaft being mounted between the first propeller and the second propeller and rotatably coupled to the main shaft and the first propeller near the first end and the second propeller near the second end;

g. a second drive shaft having a first end and an opposite second end, the second drive shaft being mounted between the first pedal and the second pedal and rotatably coupled to the main shaft and the first pedal near the first end and the second pedal near the second end;

h. a first pair of gears operatively connected to each other for transmitting power from the second drive shaft to the main shaft;

i. a second pair of gears operatively connected to each other for transmitting power from the main shaft to the first drive shaft;

j. a third pair of gears operatively connected to each other for transmitting power from the first drive shaft to the first propeller; and k. a fourth pair of gears operatively connected to each other for transmitting power from the first drive shaft to the second propeller, whereby rotation of the first pedal and the second pedal causes rotation of the main shaft through the first pair of gears, which in turn causes the first propeller and the second propeller through the second, the third and the fourth pairs of gears, respectively, to generate thrust for propelling the swimming device in a desired direction.

* * * * *